United States Patent [19]

Jones

[11] 4,362,577

[45] Dec. 7, 1982

[54] SEALING OF PHOSPHATED COATINGS

[75] Inventor: John P. Jones, Long Beach, Calif.

[73] Assignee: Purex Corporation, Lakewood, Calif.

[21] Appl. No.: 310,660

[22] Filed: Oct. 13, 1981

[51] Int. Cl.[3] ..... C23C 1/10

[52] U.S. Cl. ..... 148/6.15 R; 427/402

[58] Field of Search ..... 106/14.12; 148/6.15 R; 427/343, 402, 419.1, 419.7

[56] References Cited

U.S. PATENT DOCUMENTS

| | | | |
|---|---|---|---|
| 1,485,025 | 2/1924 | Green | 148/6.15 |
| 3,489,595 | 1/1970 | Brown | 148/6.15 R |
| 3,726,720 | 4/1973 | Guhde | 148/6.15 R |
| 3,895,970 | 7/1975 | Blum | 148/6.15 R |
| 4,148,670 | 4/1979 | Keily | 148/6.15 R |
| 4,153,478 | 5/1979 | Parant et al. | 148/6.15 R |
| 4,154,620 | 5/1979 | Miller | 106/302 |

*Primary Examiner*—Sam Silverberg

*Attorney, Agent, or Firm*—William W. Haefliger

[57] ABSTRACT

A process for sealing a phosphate coating on metal includes the steps:

(a) wetting the phosphate coated metal with a composition consisting essentially of an aqueous acidic solution containing at least one member selected from the group consisting of hypophosphorous acid, salts of hypophosphorous acid and sodium hypophosphite, (b) and then drying the thus wetted phosphate coated metal.

The solution may also contain another member selected from the group consisting of iron, steel, zinc and aluminum.

21 Claims, No Drawings

SEALING OF PHOSPHATED COATINGS

BACKGROUND OF THE INVENTION

This invention relates generally to sealing of phosphated coatings, and more particularly concerns improving the corrosions resistance of such coatings through use of solutions which do not prevent disposal problems.

Phosphate coatings on metals act to promote adhesion of enamel, paint, varnish, etc; however their corrosion resistance is less than desirable. In the past, compounds based on chromic acid or chromates have been employed as rinse additives to seal the metal and improve corrosion resistance of phosphated coatings; however, chromate rinses present waste disposal problems. Fluoride rinses are disclosed in U.S. Pat. No. 3,895,970; however, they are less advantageous than the rinses of the present invention.

SUMMARY OF THE INVENTION

It is a major object of the invention to provide a corrosion resistance improving rinse for phosphated coated metals, which does not require special treatment for waste disposal, other than neutralization.

In its process aspects, the invention involves the steps:

(a) wetting a phosphate coated metal to improve its corrosion resistance, the composition consisting essentially of an acidic solution containing at least one member selected from the group consisting of hypophosphorous acid and salts thereof, (b) and then drying the thus method phosphate coated metal.

As will appear, the solution also typically contains another member selected from the group consisting of hydrofluorosilicic acid and fluoboric acid.

A further aspect of the invention concerns provision of a wetting composition containing the described member or members.

DETAILED DESCRIPTION

The aqueous rinses or baths of the present invention are based on mixtures of hypophosphorous acid (or its salts) with hydrofluorosilicic acid; also the hypophosphorous acid (or its salts) can be used alone, or in conjunction with other acids, particularly fluoboric acid. In particular, sodium hypophosphite can be used alone or in conjunction with acid fluorides, as described herein.

As will appear, a rinse concentrate is prepared, for example, and added to or combined with a much larger (relative) volume of water. Thus, between one and two pints of the concentrate is added to or combined with 100 gallons of water, these being the relative proportions.

The preferred basic concentrate formula is:

| Formula #1 | Range | |
|---|---|---|
| | Broad | Preferred |
| 50% hypophosphorous acid | 2–99% | 5–20% |
| 30% hydrofluorosilicic acid | 0–50% | 25–35% |
| soft water | Balance | Balance |

In addition, solutions or solid materials employing salts of hypophosphorous acid may be used, for example:

| Formula #2 | Range |
|---|---|
| sodium hypophosphite | 2–100% |
| 30% hydrofluorosilicic Acid | 0–14% |
| soft water of filler material | Balance |

As an alternative to hydrofluorosilicic acid, fluoboric acid may be used:

| Formula #3 | Broad | Preferred |
|---|---|---|
| 50% hypophosphorous acid | 2–99 | 5–20 |
| Fluoboric acid, 50% | 0–50 | 25–35 |
| Soft water | Balance | Balance |

The above concentrates are combined with relatively large volumes of rinse water, to provide rinse compositions or solutions applicable to metals including iron, steel, zinc and aluminum, and to such metals after phosphate coating thereof, using known commercial phosphating solutions.

EXAMPLE

Steel Q-Panels are cleaned and phosphated using a typical proprietary iron phosphate such as is well known to the industry. Immediately following such phosphating, they are dipped in a solution bath comprised of 1 quart of the aforementioned Formula #1 (preferred range) in 100 gallons of water. The proper concentration should be maintained by adjusting the pH to 3.5–5.0. If the pH is too low, a sufficient quantity of sodium hydroxide or equivalent alkali is added to bring the pH above 3.5. If too high, more compound (Formula #1) is added until the pH is below 5.0. The temperature of the bath is from 70° to 160° F. with best results at about 140° F. The immersion (wetting) contact time is 30–60 seconds.

After dipping, the panels are air dried or force air dried and coated with an appropriate coating, usually a baking enamel, and cured as recommended by the manufacturer. They are then scribed per ASTM 1654 and exposed to salt spray testing per ASTM B117.

Corrosion protection has been found to be superior to deionized water or propriertary phosphoric acid based rinses and to approach or in many cases equal chromic acid rinses.

The rinse bath may be neutralized and disposed of into sewer lines.

In Formulas 1–3, the second member listed typically has, as its lower limit of the broad range, a 0.1 percentage.

I claim:

1. The process of sealing a phosphate coating on a metal that includes (a) wetting the phosphate coated metal with a composition consisting essentially of an aqueous acidic solution containing at least one member selected from the group consisting of hypophosphorous acid and sodium hypophosphite, (b) and then drying the thus wetted phosphate coated metal.

2. The process of claim 1 wherein said solution also contains another member selected from the group consisting of hydrofluorosilicic acid and fluoboric acid.

3. The process of claim 2 wherein said members are in the relative proportions 2 to 99 percent by weight of 50% hypophosphorous acid, and 0.1 to 50 percent by weight of 30% hydrofluorosilicic acid.

4. The process of claim 2 wherein said members are in the relative proportions 5 to 20 percent by weight of 50% hypophosphorous acid, and 25 to 35 percent, by weight, of 30% hydrofluorosilicic acid.

5. The process of claims 3 and 4 wherein the balance of the solution consists of water.

6. The process of claim 2 wherein said members are in the relative proportions 2 to 100 percent by weight of sodium hypophosphite, and 0 to 40 percent by weight of 30% hydrofluorosilicic acid.

7. The process of claim 2 wherein said members are in the relative proportions 2 to 100 percent by weight of sodium hypophosphite, and 0 to 40 percent by weight of 30% fluoboric acid.

8. The process of one of claims 6 and 7 wherein the balance of the solution consists of water.

9. The process of claim 2 wherein said members are in the relative proportions 2 to 99 weight percent of 50% hypophosphorous acid, and 0 to 50 weight percent of 50% fluoboric acid.

10. The process of claim 2 wherein said members are in the relative proportions 5 to 20 weight percent of 50% hypophosphorous acid, and 25 to 35 weight percent of 50% fluoboric acid.

11. The process of claim 10 wherein the balance of the solution consists of water.

12. The process of any one of claims 1–11 wherein said metal is selected from the group consisting of iron, steel, zinc and aluminum.

13. The process of any one of claims 1–12 wherein the solution pH is between 3.5 and 5.0.

14. The process of any one of claims 1–12 including the step of adding sodium hydroxide or equivalent alkali to the solution to raise the pH thereof to between 3.5 to 5.0, prior to said wetting.

15. The process of any one of claims 1–12 including the step of adding to the solution additional of said one member, or a combination of said members, to lower the pH of the solution to between 3.5 and 5.0, prior to said wetting.

16. The process of any one of claims 1–15 wherein said solution consists of a relatively small volume of concentrate containing said member or members added to a relatively large volume of water.

17. The process of claim 16 wherein said small and large volumes are in the relative proportions 1 to 2 pints of said concentrate and 100 gallons of water.

18. The process of any of claims 1–17 wherein said composition forms a bath at a temperature between 70° F. and 160° F.

19. The process of any one of claims 1–18 wherein the metal is immersed in the bath for a time interval between 30 and 60 seconds.

20. The process of sealing a phosphate coating on a metal that includes (a) wetting the phosphate coated metal with a composition consisting essentially of an aqueous acidic solution containing at least one member selected from the group consisting of hypophosporous acid and salts of hypophosphorous acid, (b) and then drying the thus wetted phosphate coated metal.

21. The process of sealing a phosphate coating on a metal that includes (a) wetting the phosphate coated metal with a composition consisting essentially of an aqueous acidic solution containing at least one member selected from the group consisting of hypophosphorous acid, salts of hypophosphorous acid and sodium hypophosphite, (b) and then drying the thus wetted phosphate coated metal.

* * * * *